United States Patent [19]

van Mullekom

[11] Patent Number: 4,463,910

[45] Date of Patent: Aug. 7, 1984

[54] DEVICE FOR FORMING A STORAGE COIL FROM A THREAD SUPPLIED FROM A YARN SUPPLY

[75] Inventor: Hubert P. van Mullekom, Deurne, Netherlands

[73] Assignee: Ruti-te Strake B.V., Netherlands

[21] Appl. No.: 433,084

[22] Filed: Oct. 6, 1982

[30] Foreign Application Priority Data

Oct. 28, 1981 [NL] Netherlands ..... 8104882

[51] Int. Cl.[3] ..... B65H 51/20

[52] U.S. Cl. ..... 242/47.12; 242/47.01

[58] Field of Search ..... 242/47.01, 47.12, 47.13, 242/82, 83, 47; 139/452

[56] References Cited

U.S. PATENT DOCUMENTS 4,132,370 1/1979 van Mullekom ..... 242/47.12

4,238,080 12/1980 van Mullekom ..... 242/47.01 X

FOREIGN PATENT DOCUMENTS 0060234 9/1982 European Pat. Off. ..... 242/47.01

*Primary Examiner*—Stanley N. Gilreath

*Attorney, Agent, or Firm*—Burns, Doane, Swecker & Mathis

[57] ABSTRACT

The device has a winding drum with thread guide and a rotatable disc having pins for successively moving yarn coils from the drum. The pins are driven by cranks, the crank shafts of which are driven by a second disc provided in eccentric relation to the first disc. Thereby the rotational velocity of the thread guide may be increased relative to that of the pins so that each yarn coil may comprise more windings while maintaining the separation accuracy between successive coils.

2 Claims, 3 Drawing Figures

DEVICE FOR FORMING A STORAGE COIL FROM A THREAD SUPPLIED FROM A YARN SUPPLY

The invention relates to a device for forming a storage coil from a thread supplied by a yarn supply, said device comprising a winding drum and a thread guide rotatable relative thereto, said winding drum cooperating with a disc which is provided rotatably in an axial plane within the drum chamber and is driven in a fixed transmission ratio relative to the movable part of the assembly of winding drum and thread guide, said disc carrying a plurality of pins which are rotatably connected therewith in the disc plane and are mounted with their pivots equally spaced around a pitch circle, said pins performing during the rotation of the disc a translation movement in the disc plane and successively leave through an aperture the chamber within the drum and enter the winding chamber around the drum and again leave said last mentioned chamber after a translation in axial direction.

Such a device is known.

In this known device each pin is connected, projecting in radial direction, to a pinion which is rotatably journalled on the disc. The pinions therein are through intermediate gears in engagement with a central pinion which is secured to the disc. The disc in turn is driven through a transmission drive by a drive worm which is arranged in the axis of the winding drum.

The device according to the invention differs from said known device in that eccentrically relative to the disc a second disc has been provided which is coupled with the drive, in which the pivots of the pins are constituted by the crank pins of as many cranks, the shafts of said cranks are journalled in the second disc on a pitch circle the diameter of which corresponds to that of the crank pins on the first disc carrying the pins.

Due to the inventive measure the velocity of the thread guide may be considerably increased relative to that of the pins and thereby the number of windings per supply coil without this being at the expense of the accuracy, whereby the pins effect the separation between a completed storage coil and the successive storage coil to be formed.

In a practical embodiment the second disc is constructed as a worm wheel cooperating with a worm which is secured to the end of the drive shaft of the rotatable thread guide which end extends into the drum chamber.

The invention is hereunder illustrated with reference to the drawing of an embodiment given as example.

Figure 1:
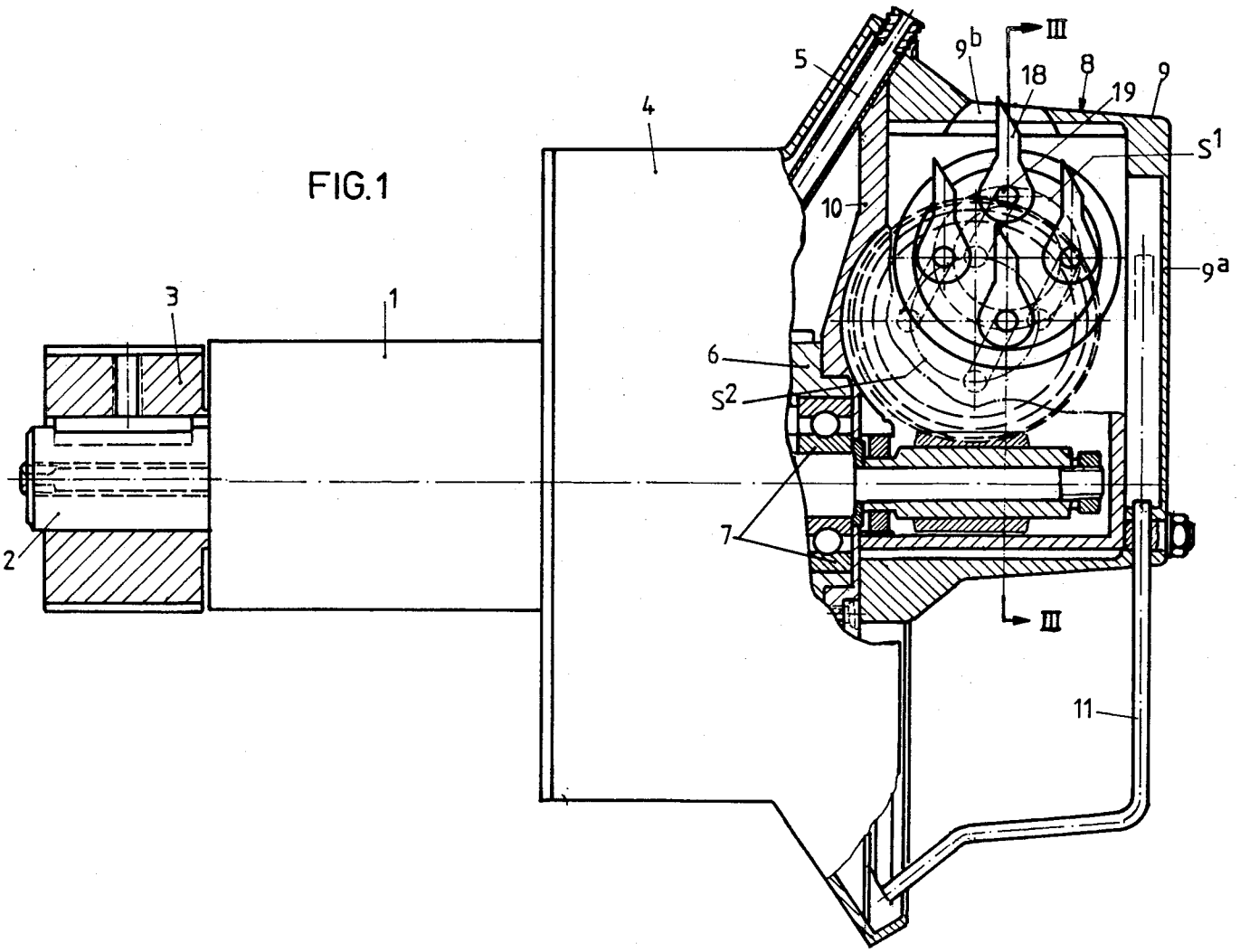
FIG. 1 shows the device according to the invention partially in side view and partially in longitudinal section.

Reference number 1 indicates a sleevelike supporting part by means of which the device may be secured to the frame of a yarn working machine, particularly a shuttleless weaving machine. A shaft 2 is rotatably journalled in said supporting part 1. A pinion 3 is provided on the end of the shaft 2 projecting to the left beyond the supporting part 1, said pinion being drivable through a suitable drive by a control shaft (not shown in detail) of the yarn working machine. Reference number 4 indicates a housing secured to the shaft 2 which housing is rotatable relative to the stationary supporting part 1 and supports the thread guide constituted by a tube 5.

Reference number 6 indicates a cylindrical hub portion which is rotatably journalled through ball bearings 7 on the shaft 2 and is coupled through a transmission mechanism (not shown in detail) within the housing 4 with the supporting part 1 such that it remains stationary when the shaft 2 rotates.

Reference number 8 indicates the yarn winding drum comprising a slightly conical housing 9 which at its right end is closed by an end wall **9*a* and is secured with its left, open end against a disc 10 carried by the hub portion 6. The drum housing 9 has an eccentric position relative to the shaft 2 and remains stationary when the shaft 2 rotates due to the fact that it has been secured to the hub portion 6**.

The housing 9 is provided with a plurality of elements 11 which are curved substantially in L-shape, along a portion of its circumference, in the embodiment shown along the half of that circumference being closest to the shaft axis, said elements each being connected with one leg adjustable in radial direction in the wall of the drum housing 9. The legs of the L-shaped elements extending substantially in the shaft direction thereby constitute together with the generatrices of the housing 9 which are most remote from the shaft 2 the winding surface of the drum.

The device as described up till now is of known construction.

Within the chamber enclosed by the housing 9 the disc-pins mechanism has been provided, to which the invention relates. This mechanism comprises a disc 13 which is mounted through supporting bearings 15 around a shaft in the housing 14, which shaft extends perpendicularly to the shaft 2 but does not intersect it. The disc 13 carries on one of its faces a plurality of cam shaped pins 18 which are bevelled at their free ends and are present in the number of four in the embodiment shown. Said pins are connected to the ends projecting beyond the housing 14 of four pins 19 which are rotatably journalled in the disc body around shafts extending parallel to the axis of the disc 13 and are equally spaced around a common pitch circle $s_1$. The pins 19 constitute the crank pins of as many cranks k, the crank shafts 20 of which are journalled in a second disc 16. Said second disc, which is in the embodiment of a worm wheel, is rotatably mounted through the intermediary of supporting bearings 22 on a supporting shaft 23 which is provided in eccentrical relation with respect to the axis of the first disc 13. The crank shafts are equally spaced around a common pitch circle $S_2$, the diameter of which is equal to that of the pitch circle $S_1$. The crank arms 21 are situated in the chamber between the discs 13 and 16 which are mounted in parallel planes and extend mutually parallel. The cam shaped pins 18 are connected to the crank pins 19 such that they likewise extend mutually parallel and are directed outwardly in a direction perpendicular to the shaft 2.

The second disc 16, which is constructed as a worm wheel, is in engagement with a worm 17 secured to the shaft 2.

Figure 2:
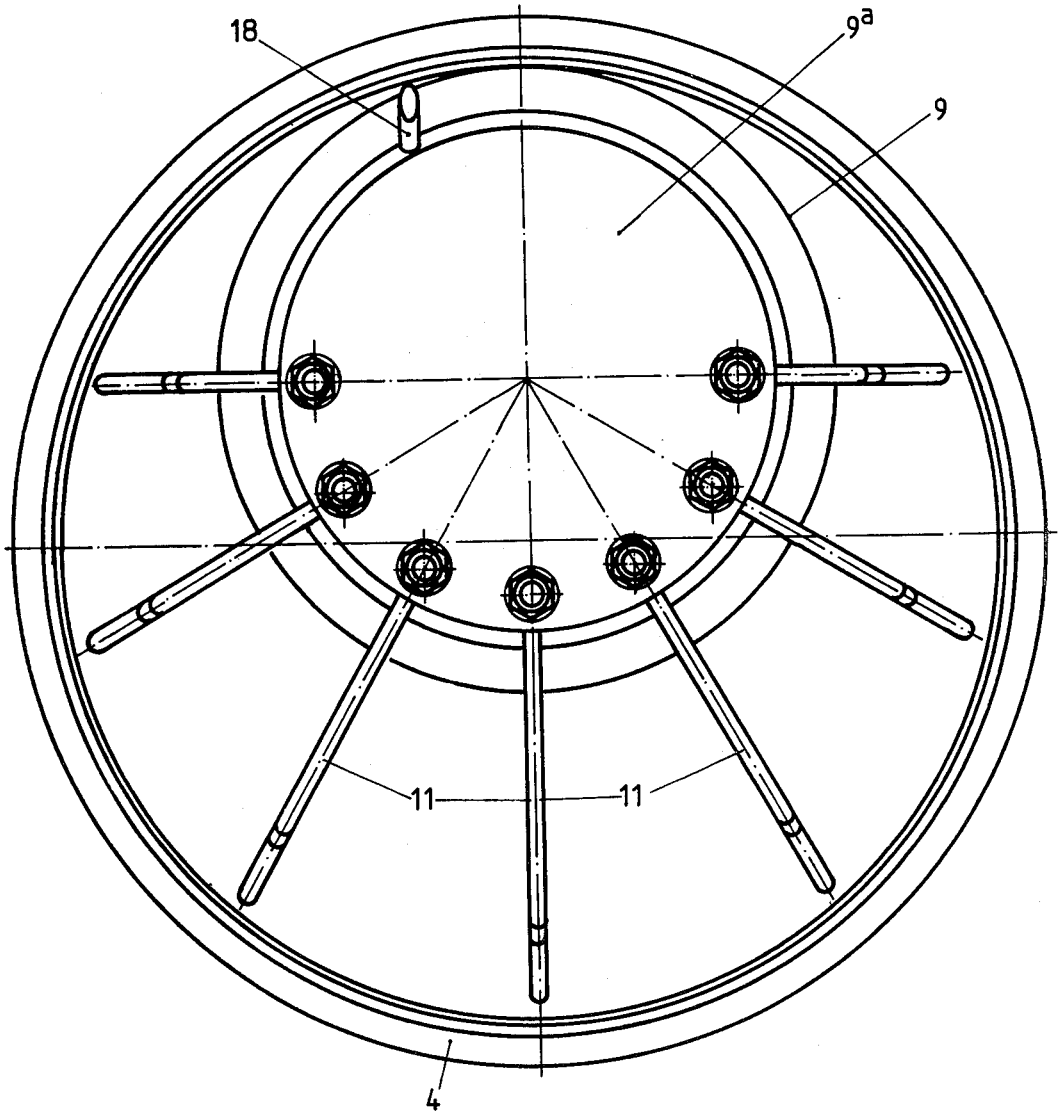
FIG. 2 is an end view as seen from the right in FIG. 1.
Figure 3:
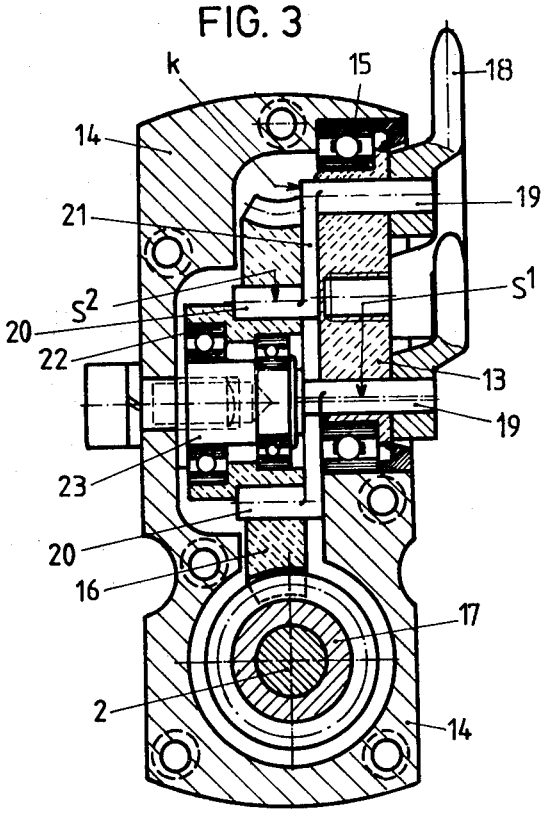
FIG. 3 shows a section through the disc-pins mechanism namely according to the line III—III in FIG. 1.

When the shaft 2 rotates the disc 16 (as seen in FIG. 2) is driven clockwise. It will be appreciated that the disc 13 is likewise driven clockwise through the cranks k and that the pins 18 carry out a translation movement. Thereby the cam shaped pins 18 enter into operation—that is when the winding tube 5 rotates—wherein they leave successively through an axial slot **9*b* in the housing 9 extending along one of the upper generatrices of the housing 9, so that they may catch the yarn windings provided by the winding tube 5 on the winding drum and move said windings in axial direction, i.e. in the drawing to the right. The advantage of the mechanism according to the invention is that the successive cam shaped pins 18** all leave the winding surface very accurately in the same point.

I claim:

1. A device for forming a storage coil from a thread supplied from a yarn supply, said device comprising a winding drum having therein a drum chamber and having an axially extending aperture communicating with the interior of said chamber, a thread guide rotatable relative to said winding drum, a first disc rotatably mounted within said drum chamber about an axis extending approximately transverse to the direction of extent of the axis of said winding drum, a plurality of pins each carried by said first disc for rotation about an axis parallel to the axis of said first disc with the several axes of pin rotation being disposed on a first pitch circle so located that end portions of the pins may sequentially protrude through and recede from said aperture in said winding drum upon rotation of said first disc relative to said winding drum, a second disc rotatably mounted within said drum chamber for rotation about an axis eccentric to the axis of rotation of said first disc, means for rotating said second disc in timed relation to the rotation of said thread guide relative to said winding drum, a plurality of crank shafts corresponding in number to said pins, each of said crank shafts being rotatably carried by said second disc with the several axes of crank shaft rotation being disposed on a second pitch circle having the same diameter as said first pitch circle, and crank arms connecting said crank shafts to said pins with each crank arm being fixed at one end portion with respect to a crank shaft and fixed at an opposite end portion to a corresponding pin.

2. A device according to claim 1, wherein said means for rotating said second disc includes a drive shaft for causing rotation of said thread guide relative to said winding drum and a worm secured to said drive shaft and wherein said second disc is constructed as a worm wheel engaging and being driven by said worm.

* * * * *